US010337194B2

(12) United States Patent
Jolicoeur et al.

(10) Patent No.: US 10,337,194 B2
(45) Date of Patent: Jul. 2, 2019

(54) WORK PLATFORM SYSTEM CONFIGURED FOR USE STRUCTURE WITH INTERNAL CAVITY, AND RELATED METHODS OF ASSEMBLY AND USE

(75) Inventors: Paul Jolicoeur, Troy, NY (US); Roy Scrafford, Scotia, NY (US); Mathieu Grumberg, Delmar, NY (US)

(73) Assignee: SAFEWAY SERVICES, LLC, Waukesha, WI (US)

( * ) Notice: Subject to any disclaimer, the term of this patent is extended or adjusted under 35 U.S.C. 154(b) by 0 days.

(21) Appl. No.: 14/127,778

(22) PCT Filed: Jun. 29, 2011

(86) PCT No.: PCT/US2011/042414

§ 371 (c)(1),
(2), (4) Date: Feb. 26, 2014

(87) PCT Pub. No.: WO2013/002790

PCT Pub. Date: Jan. 3, 2013

(65) Prior Publication Data

US 2014/0202087 A1 Jul. 24, 2014

(51) Int. Cl.

| | |
|---|---|
| ***E04G 3/30*** | (2006.01) |
| ***E04G 3/24*** | (2006.01) |
| ***E04G 5/00*** | (2006.01) |

(52) U.S. Cl.

CPC ..... *E04G 3/305* (2013.01); *E04G 3/246* (2013.01); *E04G 3/30* (2013.01); *E04G 5/00* (2013.01); *Y10T 29/49817* (2015.01)

(58) Field of Classification Search

CPC .. E04G 1/152; E04G 1/36; E04G 1/20; E04G 1/22; E04G 3/10; E06C 1/393

See application file for complete search history.

(56) References Cited

U.S. PATENT DOCUMENTS 1,090,856 A * 3/1914 Johnson ..... E06C 7/14 182/112
1,101,182 A * 6/1914 Hayward ..... E04G 3/32 182/131

(Continued)

FOREIGN PATENT DOCUMENTS

JP 09-158468 A 6/1997
JP 2002129741 A 5/2002

OTHER PUBLICATIONS

Office Action issued for Canadian Patent Application No. 2,840,414 dated Jan. 15, 2019.

*Primary Examiner* — Katherine W Mitchell
*Assistant Examiner* — Candace L Bradford
(74) *Attorney, Agent, or Firm* — Husch Blackwell LLP

(57) ABSTRACT

Work platform systems and related methods of assembly and use are disclosed herein. In one exemplary embodiment, a method of installing a work platform system into an internal cavity of a structure includes supporting a first platform portion at a first location, and adding a plurality of additional platform portions to the first platform portion, where successive ones of the additional platform portions are respectively positioned at respective locations that are successively farther outward away from the first platform portion. The method further includes coupling the additional platform portions to one or more other locations, and detaching the additional platform portions from one another. The method additionally includes lowering or raising one or more of the first and additional platform portions to one or more additional levels below or above the first level, where the work platform system includes the first and additional platform portions.

25 Claims, 13 Drawing Sheets

(56) References Cited

U.S. PATENT DOCUMENTS 1,213,043 A * 1/1917 Walker ..... E04G 1/36 182/128
2,221,133 A * 11/1940 Gladville ..... E04G 3/24 182/128
2,346,033 A * 4/1944 Marsden ..... E04G 3/24 182/128
2,623,643 A * 12/1952 Seamans ..... E04G 5/06 212/179
3,080,941 A * 3/1963 Fuller ..... E04G 1/362 182/152
3,166,154 A * 1/1965 Titzel ..... C21C 5/44 182/128
3,241,634 A * 3/1966 Prosser ..... B66B 9/187 182/128
3,259,208 A * 7/1966 Behr ..... C21C 5/44 182/128
3,488,898 A * 1/1970 Scaggs ..... E04H 3/123 182/132
3,894,614 A * 7/1975 Naka ..... A62B 1/00 182/78
3,907,066 A * 9/1975 Newton ..... E04G 3/24 182/112
4,058,184 A * 11/1977 Stuart ..... E04G 1/36 182/128
4,068,419 A * 1/1978 Decoppet ..... E04G 1/36 52/40
4,095,670 A * 6/1978 Martin ..... E04G 3/00 182/128
4,125,174 A * 11/1978 Lienhard ..... E04G 1/14 182/128
4,671,382 A * 6/1987 D'Alessio ..... E04G 1/36 182/128
4,696,135 A * 9/1987 Kallinger ..... E04H 12/34 249/20
5,301,707 A 4/1994 Regan et al.
5,301,770 A * 4/1994 Regan ..... E04G 3/30 182/128
5,311,966 A * 5/1994 Daniels ..... B61D 49/00 182/128
5,343,978 A 9/1994 VanAmburg
6,009,975 A * 1/2000 Coenders ..... E04G 3/00 182/128
7,726,447 B2 6/2010 Kawaguchi et al.
7,779,599 B2 8/2010 Jolicoeur et al.
2005/0217936 A1* 10/2005 Jolicoeur ..... E01D 19/106 182/130
2008/0302605 A1* 12/2008 St-Germain ..... E04G 1/20 182/223
2010/0175951 A1 7/2010 Winson et al.
2010/0175957 A1 7/2010 Winson et al.

* cited by examiner

WORK PLATFORM SYSTEM CONFIGURED FOR USE STRUCTURE WITH INTERNAL CAVITY, AND RELATED METHODS OF ASSEMBLY AND USE

CROSS REFERENCE TO RELATED APPLICATIONS

Field of the Invention

The present invention relates, generally, to the field of work platforms that are erected to access various parts of various structures. More particularly, the present invention relates to work platforms that can be erected within structures having large internal volume chambers and including, for example, conic structures.

Background of the Invention

A number of types of work platforms are available on the market for use in a variety of environments, circumstances, and projects including, for example, construction or maintenance projects. Whether a project is a public works project (e.g., low bid), or a private project, reducing and/or maintaining costs is critical to the contractor(s) and the owner. One environment in which work platforms are used is within structures providing large internal volume chambers. Such work platforms can be employed for various reasons including, for example, to allow workers to work within the chambers to perform various construction procedures, such as assembling structures within the chamber, and/or various maintenance procedures such as inspecting and cleaning, repairing or refurbishing the interior of the chamber or performing repairs along the internal walls surrounding the chamber.

Some such structures having large internal chambers in which work platforms are employed are large conical primary separation vessels utilized to extract oil from the oil sands. Such conical structures are downwardly-oriented (downwardly-pointing, or funnel-shaped) cones having a cross-sectional horizontal area that decreases as one moves downwardly from the top of the structure toward the bottom (toward where the tip is located, or would be located if the tip was not removed). Often the heights and diameters of the interior chambers within such conical structures can be quite large, for example, on the order of 50 to more than 100 feet. Due to the abrasive materials processed in these conical structures, these structures require frequent inspections, cleanings, and repairs, for example, to repair worn internal walls (worn down due to exposure to sand/rock) or perform other spot repairs, to weld in steel plating (e.g., particularly near the bottom of the structure), and/or to repair equipment mounted within the interior chambers.

A desirable work platform in a conical structure such as that mentioned above will have platform portions extended alongside the interior surfaces of the conical structure typically at a variety of height levels within the structure, so as to allow workers to access and execute scope of work to substantial portions of those internal surfaces, or even all or substantially all portions of the internal surfaces. Yet construction of a work platform having portions positioned to allow for satisfaction of these goals is typically costly and time-consuming, both because of the size of the internal chamber and because the shape of the internal walls of the chamber make it difficult to assemble the work platform due to the walls being generally all inclined outward as one progresses upward within the internal chamber. These difficulties are experienced with a number of different types of work platform systems, for example, Regardless of whether the work platform is assembled mostly outside of the conical chamber at a different location and then brought into the conical chamber, or assembled from scratch within the conical chamber.

For at least these reasons, therefore, it would be advantageous if a new or improved work platform system and/or method of use (e.g., in terms of installing the work platform system) could be developed that addressed one or more of the above-described concerns.

SUMMARY OF THE INVENTION

In at least some exemplary embodiments, the present invention relates to a method of installing a work platform system into an internal cavity of a structure. The method includes supporting a first platform portion at a first location in relation to the internal cavity, and adding a plurality of additional platform portions to the first platform portion, where successive ones of the additional platform portions are respectively positioned at respective locations that are successively farther outward away from the first platform portion along or proximate to a first level. The method further includes coupling the additional platform portions to one or more other locations so that the additional platform portions are supported in relation to the structure, and detaching the additional platform portions from one another. Additionally, the method also includes lowering or raising one or more of the first platform portion and additional platform portions to one or more additional levels below or above the first level, where the work platform system includes the first platform portion and the additional platform portions.

Further, in at least some additional exemplary embodiments, the present invention relates to a work platform system configured for implementation within a cavity defined by one or more interior walls within a structure. The work platform system includes a starter assembly including at least one component that is configured to be supported at a first location substantially above the cavity and further including a first platform portion coupled to the at least one component, and a plurality of additional platform portions configured to be positioned along or proximate to the one or more interior walls. The work platform system also includes a plurality of suspension components by which the additional platform portions are linked to one or more of the first location and one or more of a plurality of additional locations substantially above the cavity. The first and additional platform portions are respectively positioned so that each respective one of the platform portions is at a respective vertical level along a vertical axis extending through the cavity and through the first platform portion, and successive ones of the additional platform portions are respectively positioned successively outwardly relative to the vertical axis.

Additionally, in at least some further exemplary embodiments, the present invention relates to a work platform system into an internal cavity of a structure. The method includes supporting a first platform portion in relation to the internal cavity at a first level, and adding a plurality of additional platform portions to the first platform portion, where each of the additional platform portions is respectively positioned substantially concentrically around a respective subset of the first and additional platform portions and each successive one of the additional platform portions is positioned further radially outwardly from the first platform portion. The method also includes coupling the additional platform portions to one or more other locations by way of a plurality of suspension components so that the additional platform portions are supported in relation to the internal cavity in a manner other than by way of the first platform portion, and detaching the additional platform portions from one another. The method additionally includes lowering one or more of the first platform portion and additional platform portions to one or more additional levels below the first level, and interconnecting the first and additional platform portions at the first level and the one or more additional levels by way of additional components that are configured to facilitate movement of personnel or machinery among the platform portions. The first and additional platform portions subsequent to the lowering are arranged so as to conform to an inverted conical shape of the internal cavity.

DETAILED DESCRIPTION

Figure 1:
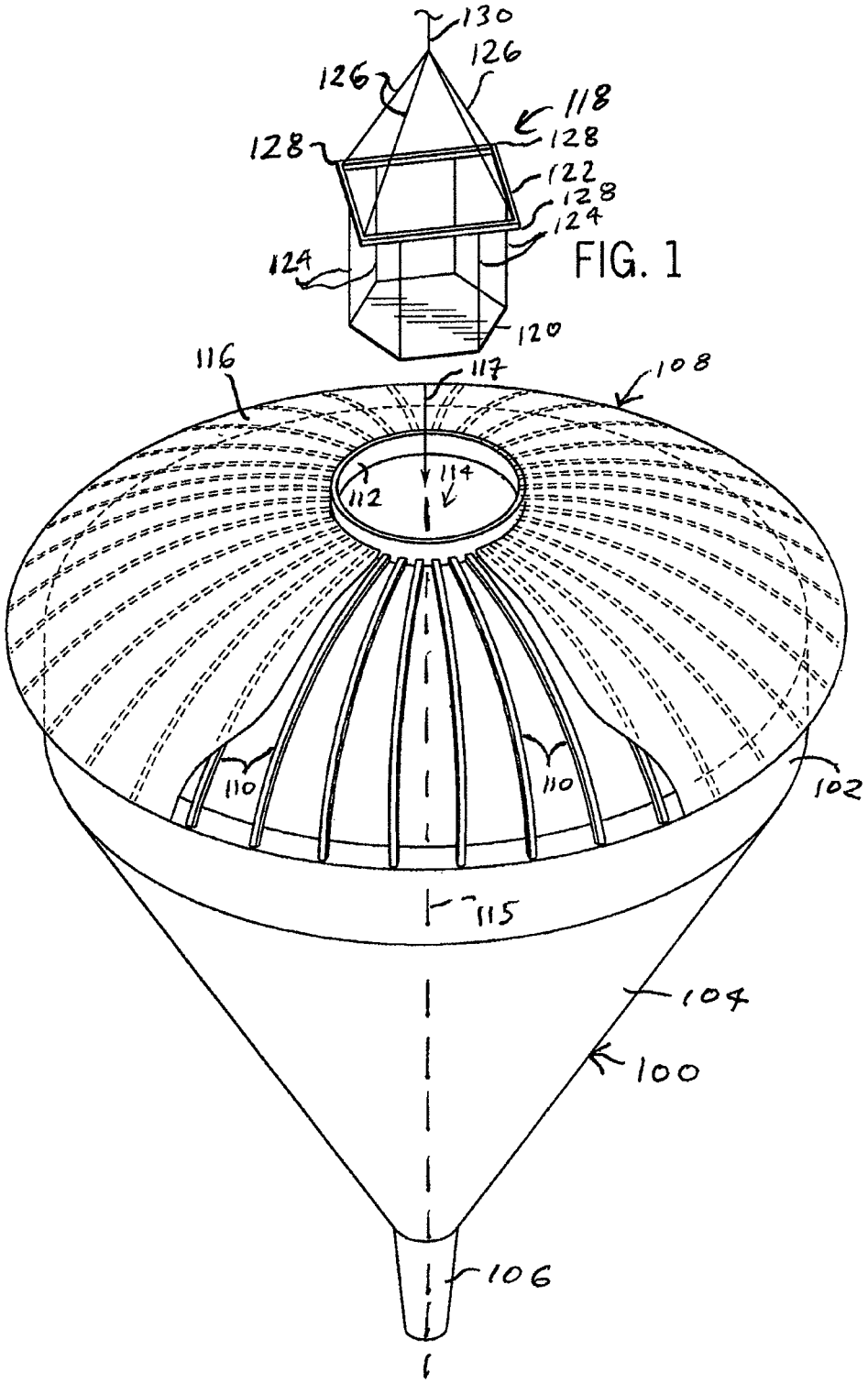
FIG. 1 is a perspective, partially cutaway view showing an example structure with a large internal cavity in which a work platform system is to be implemented, which in this example particularly is a downwardly-orientated conical (funnel-shaped) separation vessel where, in accordance with at least one embodiment, a cap with rigid top beams is formed across a top of the vessel linking an outer upper rim of the vessel with a ring in the middle forming an open orifice, along with an upper portion of the work platform system having a starter platform, where the upper portion is suspended above and about to be positioned into the ring corresponding to an initial stage of implementation of the work platform system.

FIGS. 1-4, 9, and 11-13 illustrate various steps of an example process of implementing an example work platform system within a structure having a large interior chamber. In the present example embodiment, the structure within which the work platform system is implemented is a downwardly-orientated conical (funnel-shaped) separation vessel 100, having both a diameter and a height of approximately 50 to 100 feet, as is used in the oil sands industry particularly for the purpose of separating oil from oil sand. As shown, the separation vessel 100 particularly includes a top rim 102 that is circular, and a conical wall 104 that extends downward from the top rim to a bottom tip region 106 that extends downward somewhat off of the conical wall. As shown, the conical wall 104 is shaped and orientated such that its cross-sectional horizontal area decreases as one moves downwardly from the top rim 102 of the structure toward the bottom (toward where the bottom tip region 106 is located, or would be located if the tip was not removed). Although this progression occurs smoothly and in uniform manner as shown, in other embodiments the conical wall 104 can be generally conical while still having features that are not conical (for example, a portion of the wall that juts outward from the remainder of the wall).

Notwithstanding that the description provided herein particularly focuses upon implementation of a work platform system within the vessel 100, this is only intended as an example. Indeed, it should be appreciated that the same or similar (or substantially similar) processes for implementing work platform systems, and/or the same or similar (or substantially similar) work platform systems and/or associated component(s), can be utilized in connection with a variety of other types of structures having large internal chambers within which the work platform systems are to be erected, positioned, or otherwise implemented. For example, while the vessel 100 is a conical structure having the top rim 102 that is circular, in other embodiments, the structure within which the work platform system is implemented can be a downwardly-orientated pyramidal structure (e.g., with a top rim that takes the shape of a square, rectangular, or some other polygon). Also, it is envisioned that the same or similar (or substantially similar) work platform systems, and/or the same or similar (or substantially similar) work platforms and/or associated components, can be utilized in relation to other structures having large internal chambers, even where those structures have walls that do not progress inwardly towards one another as one proceeds downward from the top of the structure to the bottom of the structure. In particular, encompassed herein are also embodiments in which the work platform systems are configured to be implemented in a conical structure or polygonal structure in which the walls of the structure proceed inwardly toward one another as one proceeds upwardly rather than downwardly (e.g., the tip of the structure is at the top rather than the bottom).

Referring particularly to FIG. 1, in the present embodiment, the process of implementing a work platform system within the vessel 100 begins by provision of a cap 108 extending over the top rim 102 of the vessel. As shown, the cap 108 more particularly includes a plurality of rigid top beams (or roof rafters) 110 extending inwardly from the top rim 102, upon which those beams (and the cap) are supported, up to an inner ring 112 forming on orifice (or oculus) 114 in the middle of the cap. A vertical axis 115 extends from the bottom tip region 106 of the vessel 106 all of the way through the vessel up through the center of the orifice 114 (an arrow 117 also shown to be along this axis is discussed further below). In the present embodiment, an annular roof or ceiling portion 116 rests upon the rigid top beams 110 so as to extend inward from the top rim 102 to the inner ring 112. FIG. 1 particularly shows a portion of the annular roof 116 removed to better reveal some of the beams 110 (which are otherwise shown in phantom), albeit it should be understood that the annular roof forms a complete annulus extending around the ring 112. Although in the present embodiment the cap 108 and its various subcomponents 110, 112, 114, 116 can be considered a part of the work platform system, it can also alternatively be considered a part of the vessel 100 that preexists establishment of the work platform system.

Further as shown in FIG. 1, the beginning of the process of the implementing of the work platform system additionally includes provision of a starter assembly 118 having a hexagonal starter platform portion (or simply starter platform) 120 suspended beneath a square (or rectangular) spreader frame assembly 122. The connection of the starter platform 120 to the spreader frame assembly 122 can be achieved using suspenders or linkages 124, which in the present embodiment are flexible linkages such as chains or wire ropes but, in alternative embodiments, can also or instead be achieved using other types of linkages such as rigid bars. In the present embodiment, there are six of the linkages 124 linking each of the corners of the hexagonal starter platform to corresponding locations along the spreader frame assembly 122. The starter assembly 118 overall is suspended from a crane or other lifting mechanism (not shown), by way of additional suspenders 126 attached to four corners 128 of the spreader frame assembly 122 that are all coupled to an ultimate hoisting linkage 130 (shown in cutaway), which in turn is coupled to the crane or other lifting mechanism. In at least one embodiment, the linkages 124 and hoisting linkage 130 are chains that are all connected to one another by way of one or more chain links or loops.

Figure 2:
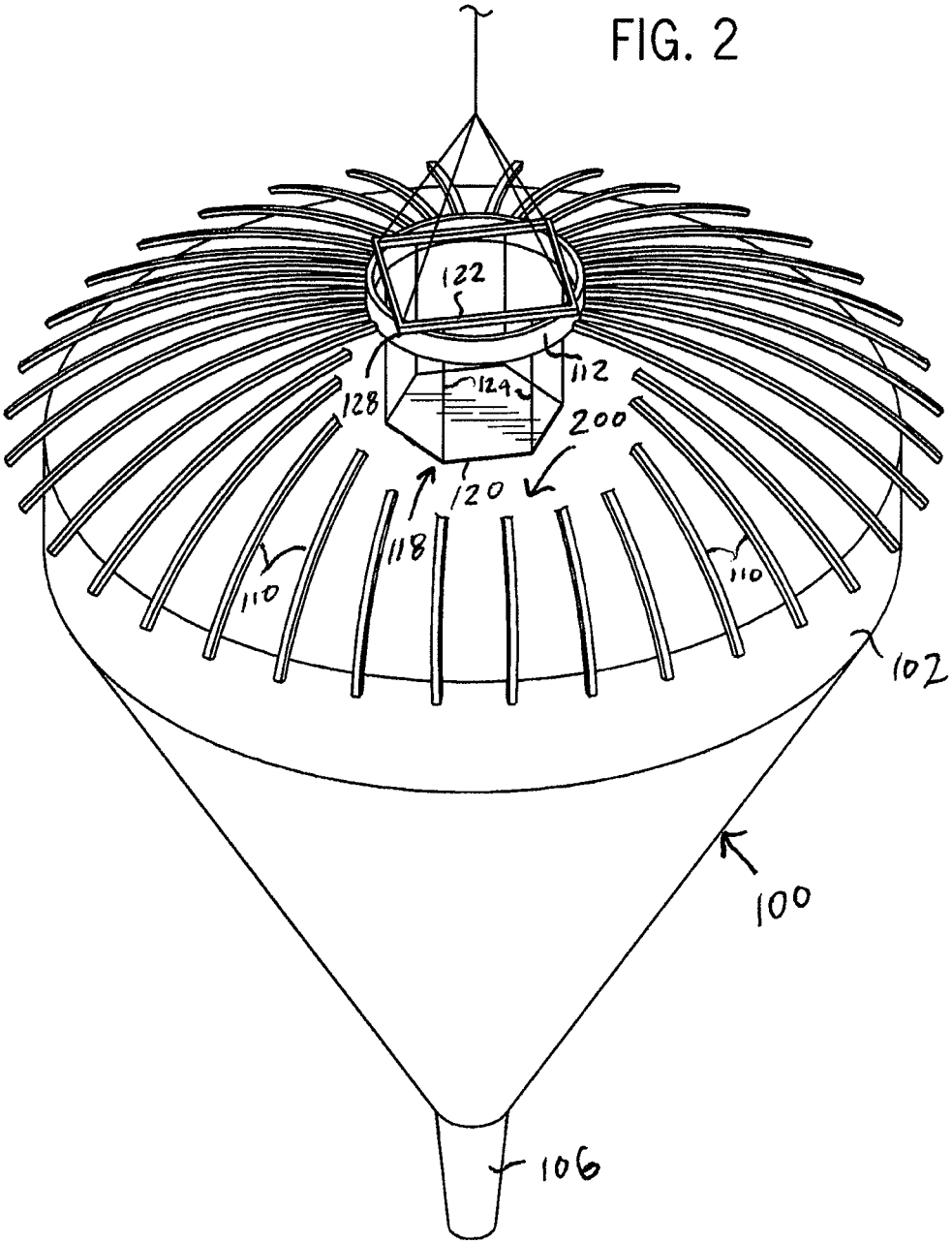
FIG. 2 is a further perspective, partially cutaway view of the vessel of FIG. 1 shown with the cap and portions of some of the rigid top beams removed, along with the upper portion of the work platform system now positioned within the ring, as occurs during a subsequent stage of implementation of the work platform system.

Turning to FIG. 2, at a second step in the process of implementing the work platform system, by virtue of appropriate lowering of the starter assembly 118 by way of the crane or other lifting mechanism, the starter assembly 118 is lowered into and through the ring 112 (e.g., in a direction as indicated by an arrow 117 shown in FIG. 1) so that the spreader frame assembly 122 rests upon the top of the ring and is supported thereon. More particularly, it will be noted from FIG. 2 that the corners 128 of the spreader frame assembly 122 particularly extended outward over the ring 112 so that the ring can support the spreader frame assembly, while the linkages 124 extend downward through the ring and into an interior chamber 200 within the vessel 100 and covered by the cap 108, such that the starter platform 120 particularly is then positioned within that interior chamber. To better illustrate the relative positioning of these structures in this regard, the annular roof 116 is no longer shown in FIG. 2 and portions of the beams 110 (particularly portions of the beams by which the beams are coupled to the ring 112) are cutaway, albeit it should be understood that in actuality these missing structures are in fact present.

Figure 3:
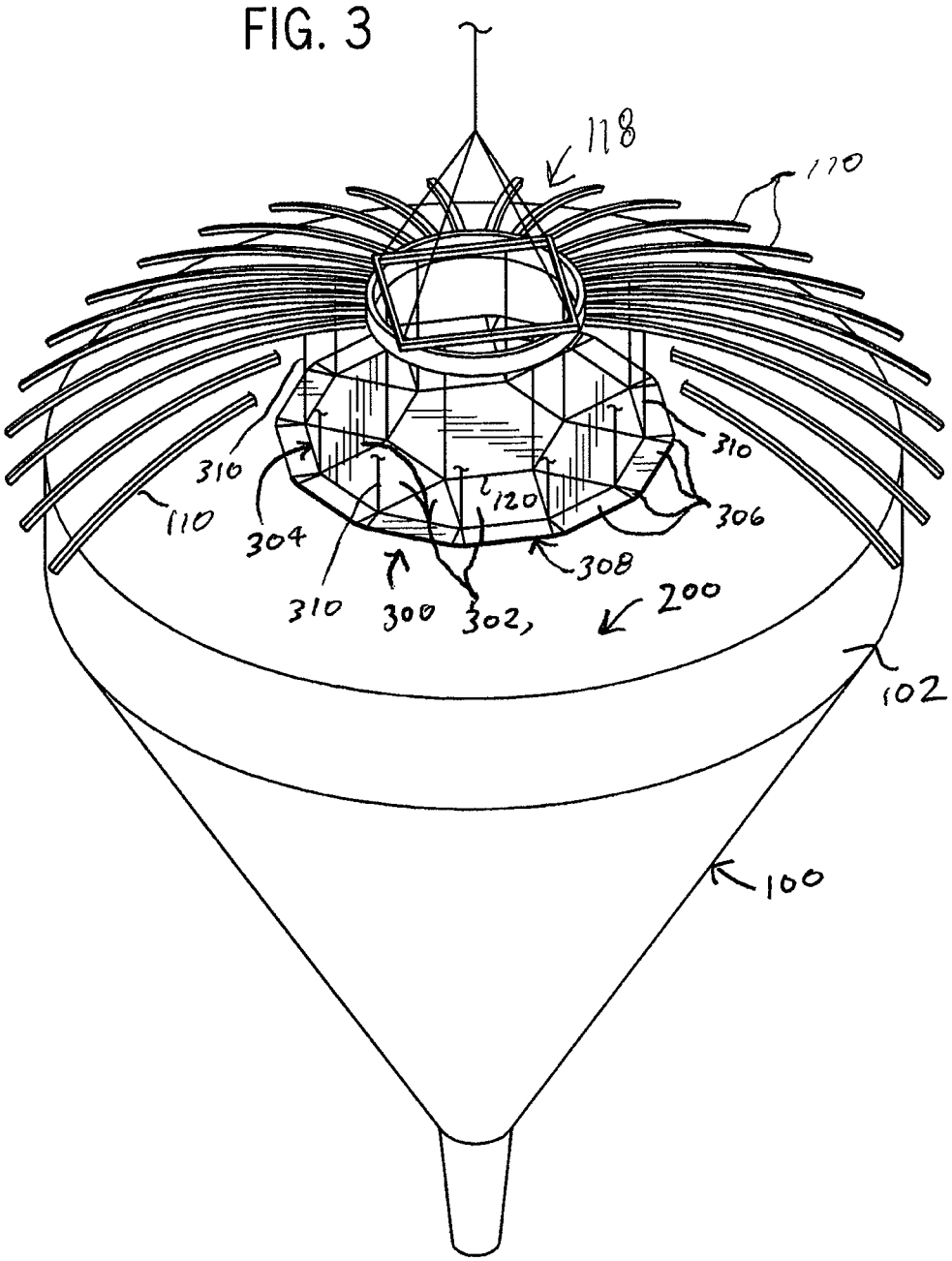
FIG. 3 is a further perspective, partially cutaway view of the vessel of FIGS. 1 and 2 shown with the cap and some of the rigid top beams or portions of some of those beams removed, along with the starter platform of the work platform system now modified to include additional extension platform portions around it, representative of a further stage of implementation of the work platform system.

Turning next to FIG. 3, a further perspective, partially cutaway view of the vessel 100 of FIGS. 1 and 2 is shown with the roof 116 and several of the beams 110 and portions of the beams removed for simplicity of illustration (albeit again it should be understood that the missing roof and beams/beam portions in fact are present). As shown in FIG. 3, once the starter assembly 118 is in position as shown in FIG. 2 such that the starter platform 120 is within the interior chamber 200 at a sufficiently low level that the starter platform level coincides with the level within the chamber having the largest horizontal cross-sectional area or diameter (e.g. at the level of the rim 102), additions can be made to the starter platform. More particularly in this regard, FIG. 3 illustrates a step of the process of implementing the work platform system in which a first additional platform portion 300 has been added around the starter platform 120. As shown, the first additional platform portion 300 particularly includes a series of main platform portions 302 that are positioned immediately around the starter platform 120 so as to form a first platform ring 304, as well as a series of intermediate portions 306 that are positioned immediately around that platform ring formed by the main platform portions 302 so as to form a further intermediate ring 308.

Although the first additional platform portion 300 is described as encompassing the rings 304 and 308, it will be observed that, more accurately speaking, main platform portions 302 and intermediate portions 306 encompass rectangular/square and triangular portions that in combination with one another approximate an annular shape without being exactly annular. That is, the main platform portions 302 provide a ring-like structure (the ring 304) having six sides internally, adjacent the six sides of the hexagonal starter platform 120, while having twelve sides or a dodecagon-shape externally, while the intermediate portions 306 provide a ring-like structure (the ring 308) having twelve sides internally and twenty-four sides externally. Notwithstanding these particular shapes, it should be understood that numerous other arrangement are possible depending upon the embodiment, and this particular arrangement is partly reflective of the use of the hexagonal starter platform 120.

As also illustrated, the first additional platform portion 300 is suspended vertically by way of additional linkages 310 by which that additional platform portion is connected to ones of the beams 110. In FIG. 3, due to the manner in which the beams 110 are illustrated, several of the additional linkages 310 are shown in cutaway, albeit it should be understood that these additional linkages are in actuality coupled to those of the beams that are directly above those additional linkages. In the embodiment shown, the additional linkages 310 particularly link each of the outer corners of the ring 304 (twelve in all) with corresponding ones of the beams 110, although in other embodiments linking connections can be established at or with other points/sections of the additional platform portion 300. Also, depending upon the embodiment, the additional linkages 310 can take a variety of forms, for example, flexible linkages or suspenders such as wire rope or chain linkages, and/or other types of linkages such as rigid linkages.

Figure 4:
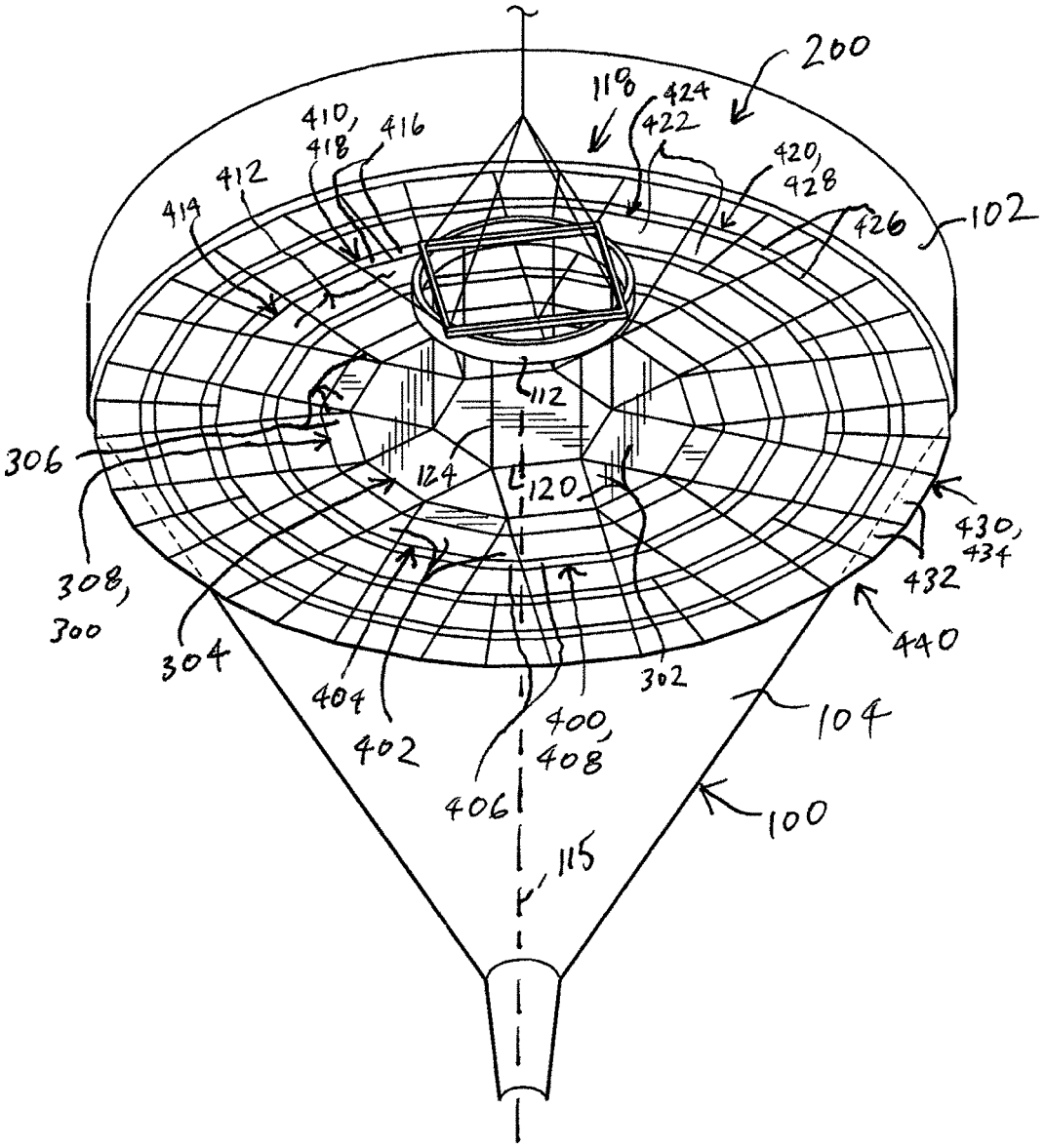
FIG. 4 is an additional perspective, partially cutaway view of the vessel of FIGS. 1-3 now shown with the cap and a portion of the outer upper rim of the vessel and other conical wall portions of the vessel removed to reveal the work platform system positioned within the vessel in a further stage of implementation in which the starter platform has been modified to include multiple additional extension platform portions around it, the additional extension platform portions substantially forming concentric rings surrounding the starter platform, which is representative of an additional stage of implementation of the work platform system.

Referring to FIG. 4, the implementation of the work platform system continues with further additional platform portions being constructed (mounted) circumferentially around the starter platform 120 and the first additional platform portion 300. In particular, in the present embodiment, a second additional platform portion 400 is formed that includes main platform portions 402 that form a second platform ring 404 surrounding the ring 308, as well as intermediate platform portions 406 that form a second intermediate ring 408 that surrounds the second platform ring. Further, a third additional platform portion 410 is formed that includes main platform portions 412 that form a third platform ring 414 surrounding the second intermediate ring 408 and intermediate platform portions 416 that form a third intermediate ring 418 that surrounds the third platform ring. Further, a fourth additional platform portion 420 is formed that includes main platform portions 422 that form a fourth platform ring 424 surrounding the third intermediate ring 418, and intermediate platform portions 426 that form a fourth intermediate ring 428 that surrounds the fourth platform ring. Additionally, a fifth additional platform portion 430 is formed that includes main platform portions 432 that form a fifth platform ring 434 surrounding the fourth intermediate ring 428 (the fifth additional platform portion does not, however include any intermediate platform portions or intermediate ring). As illustrated, the fifth platform ring 434 extends up to, or nearly up to, the top rim 102 in the present embodiment. It should be appreciated from the above description that the "platform rings" can be considered platform portions as well.

Thus, an overall platform structure 440 is formed from the combination of the starter assembly 118 along with the combination of all of the aforementioned platform portions, including both the starter platform 120 and all of the nine rings concentrically positioned surrounding the starter platform, namely, the rings 304, 308, 404, 408, 414, 418, 424, 428, and 434. As illustrated, each successive one of the rings 304, 308, 404, 408, 414, 418, 424, 428, 434 is positioned successively radially outwardly away from the starter platform 120 and the vertical axis 115 extending through the vessel 100 (likewise, this can also be said of the platform portions 302, 306, 402, 406, 412, 416, 422, 426, 432 of those successive rings, as well as the successive additional platform portions 300, 400, 410, 420, 430 each encompassing one or more of those rings). To facilitate illustration of all of the additional platform portions 300, 400, 410, 420, 430, FIG. 4 only shows rear portions of the top rim 102 and the conical wall 104 of the vessel 100 (the remaining portions cutaway), and the entire cap 108 aside from the ring 112 is also removed. Nevertheless, it should be understood that, in actuality, the cap 108 and vessel 100 are present in their entirety (e.g., as shown in FIG. 1).

Figure 5:
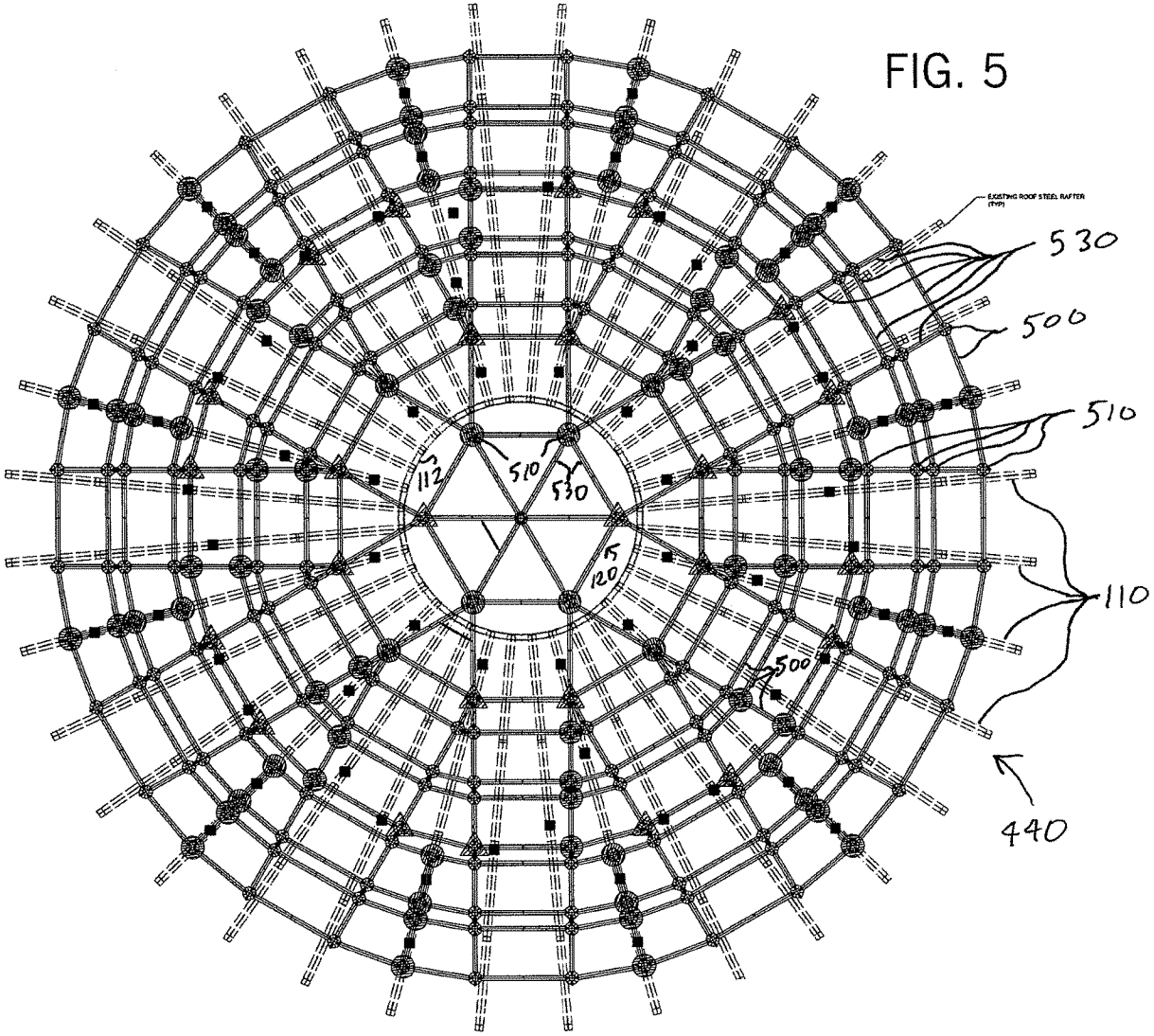
FIG. 5 is a top plan view of several example components employed to form the platform portions of the work platform system, particularly interconnected hub and joist components employed in this regard, as well as several other structures including the rigid top beams of the cap that are positioned above those platform portions.

Referring to FIG. 5 in addition to FIG. 4, it should be appreciated that the overall platform structure 440 includes both internal/underlying support components (e.g., a "skeleton") as well as exterior surface components resting atop (and/or, in alternate embodiments, possibly beneath) those internal support components, which serve as surfaces upon which persons (e.g., work personnel) can walk and/or upon which tools or machinery can be supported and moved. FIG. 4 particularly shows the exterior surface components, which typically are flat panel portions. That is, the references to the platform portions 302, 306, 402, 406, 412, 416, 422, 426, 432 can be equally understood to be references to panel portions that are provided at those respective locations as part of the platform portions. Various ones of such panel portions can be made of different materials depending upon the embodiment. In at least some embodiments, the panel portions employed in forming the platform portions 406, 416, 426 associated with the intermediate rings 408, 418, 428 can be made of plywood while the panels employed in forming the platform portions 302, 402, 412, 422, 432 associated with the platform rings 304, 404, 414, 424, 434 (as well as possibly the starter platform 120) can be made of sheet metal or plastic that is more robust. Such an arrangement is particularly appropriate insofar as, as will be discussed further below, the process of erecting the work platform system ultimately involves the separation of the platform rings 304, 404, 414, 424, 434 from one another and from the starter platform 120 so as to be spaced at different vertical levels within the vessel 100.

Referring particularly to FIG. 5, example components 500 employed to form the underlying/internal supporting portions (e.g., the "skeleton") of the overall platform structure 440, particularly interconnected hub components (or simply hubs) 510 and joist components (or simply joists) 530 employed in this regard, are shown along with the rigid top beams 110 and ring 112 of the cap 108 that are positioned above the overall platform structure. For simplicity of illustration, the vessel 100 is not shown in this illustration, nor is the roof 116 of the cap 108 (nor are the panels discussed above, which are supported upon these hub and joist components), albeit such structures/components should be understood to be present in actuality. In the present embodiment, the rigid top beams 110 particularly are shown to include thirty-six (36) beams extending outward radially from the ring 112 and spaced equidistantly from one another in terms of the distances and angular spacing between adjacent beams. Further, the starter platform 120 is also shown to be internally assembled from a series of interconnected ones of the hubs 510 and joists 530 as are described further in detail with respect to FIGS. 6, 7, and 8A-8B.

Figure 6:
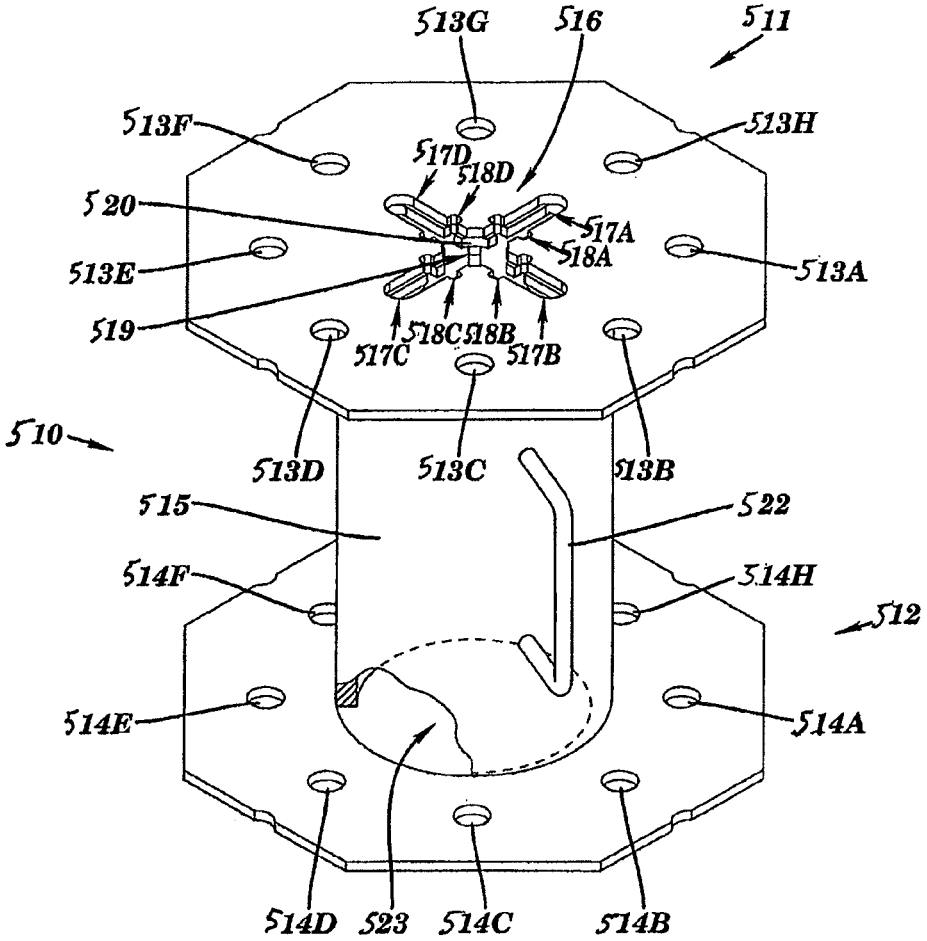
FIG. 6 shows in more detail an example hub such as can be used in forming the platform portions of FIG. 5.
Figure 7:
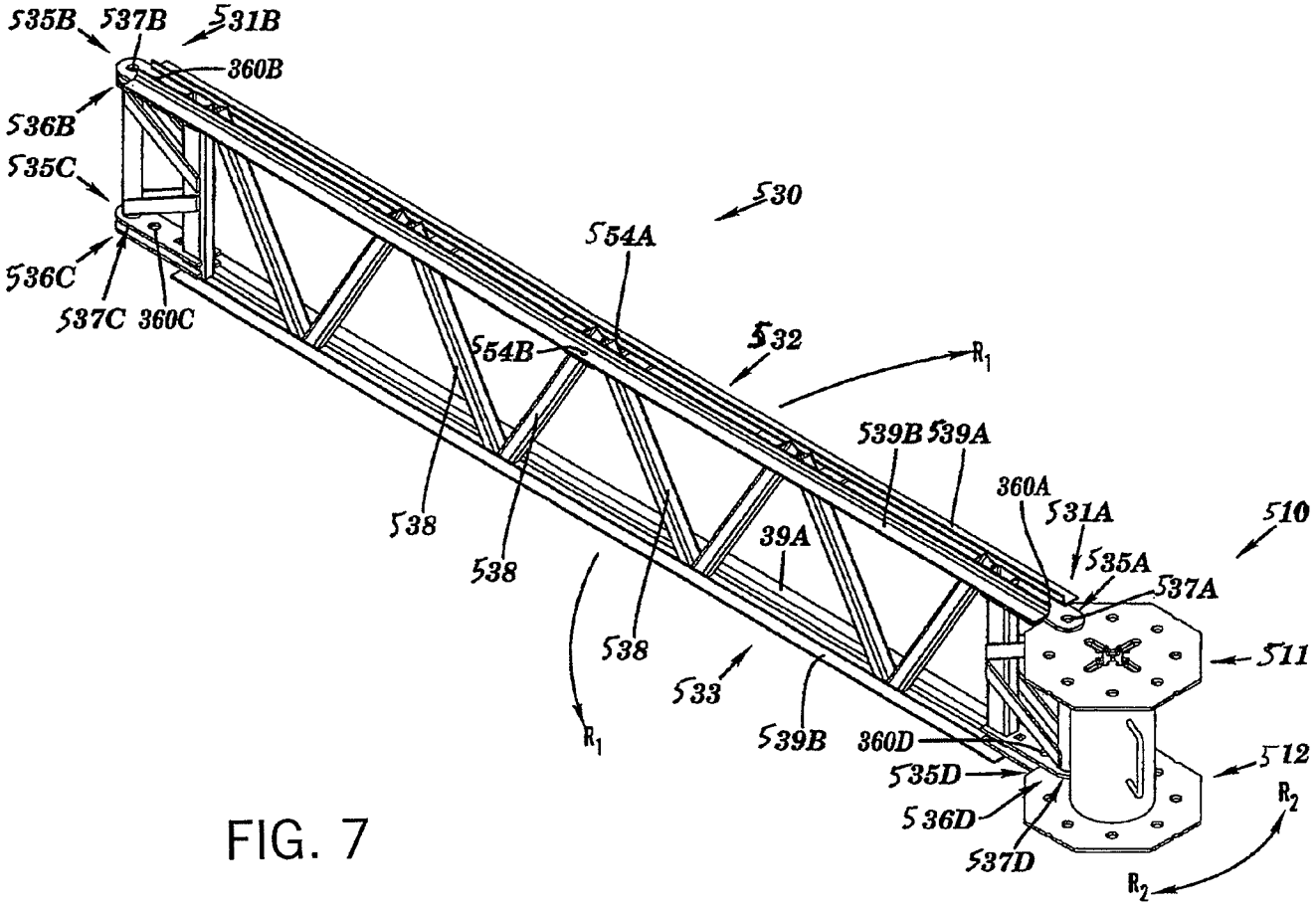
FIG. 7 shows in more detail an example joist such as can be used in forming the platform portions of FIG. 5.

Turning then to FIGS. 6 and 7, there is illustrated in more detail an example of one of the hubs 510, as well as one of the hubs 510 in connection with a given one of the joists 530. A joist can be considered any elongate structural member adapted for bearing or supporting a load, such as a bar joist, truss, shaped-steel (i.e., I-beam, C-beam, etc.), or the like. The hub 510 is configured so that, when attached to one of the joists 530, the hub 510 is capable of articulation relative to the joist 530 (and vice-versa). A hub is an interconnection structure, such as a node, hinge, pivot, post, column, center, shaft, spindle, or the like. Articulation, as used herein, is defined as the capability to swing, and/or rotate, about a pivot point or axis. This articulation feature among other things allows for less manpower to readily assemble and disassemble components of the system in, or near, the desired finished position.

The hub 510 includes a top element 511 and a bottom element 512 spaced at distal ends of a middle section 515. The top element 511 and bottom element 512 can be substantially planar in configuration, as well as parallel to each other. The top element 511 and bottom element 512, in the embodiment shown, are substantially planar surfaces that are octagonal in shape (as viewed from a plan view). The middle section 515 can be a cylindrical section where a longitudinal axis of the middle section 515 is normal to the planes of the top element 511 and bottom element 512. In the embodiment shown, the middle section 515 is a right circular cylinder. In FIG. 6, a lower portion of the middle section 515 is removed for clarity to reveal that the middle section 515 is hollow.

Further as shown in FIG. 6, there are a plurality of openings 513, 514, extending through both the top element 511 and bottom element 512, respectively. The plurality of openings 513 (e.g., 513A, 513B, 513C, 513D, 513E, 513F, 513G, 513H) are interspersed on the top element 511 so as to offer various locations for connecting to one or more of the joists 530 (see, e.g., FIG. 7). The plurality of openings 514 (e.g., 514A, 514B, 514C, 514D, 514E, 514F, 514G, 514H) are similarly spaced on the bottom element 512 so that respective pairs of the openings 513 and 514 (e.g., 513A and 514A) are coaxial. Also as shown, at the center of the top element 511 is a center opening 516 which is configured to receive a linkage or suspension connector (such as the linkages 124, 310 mentioned above) by which the hub 510 can be suspended from the beams 110 or the spreader frame assembly 122.

The center opening 516 can be generally cruciform in configuration with a center opening area 519 and four slots 517 (e.g., 517A, 517B, 517C, 517D) extending therefrom. Transverse to each of the four slots 517A, 517B, 517C, 517D, and interconnected thereto, are also a series of cross slots 518A, 518B, 518C, 518D. For added strength a reinforcing plate 520 is added to the underside of the top element 511, where openings on the reinforcing plate 520 correspond to (and are generally coextensive with) the center opening 516 configuration and all the ancillary openings thereto (e.g., the slots and area 517, 518, 519). A handle 522 is optionally added to a side of the middle section 515. Although not visible in FIGS. 6 and 7, it should be appreciated that an identical opening is formed on the bottom element 512, and the bottom element along its top side can likewise include a reinforcing plate with the same opening. Also not shown, attached to the reinforcing plate along the bottom element 512 and the interior face of the middle section 515 can be a plurality of gussets that provide added support to the hub 510.

Figure 8B:
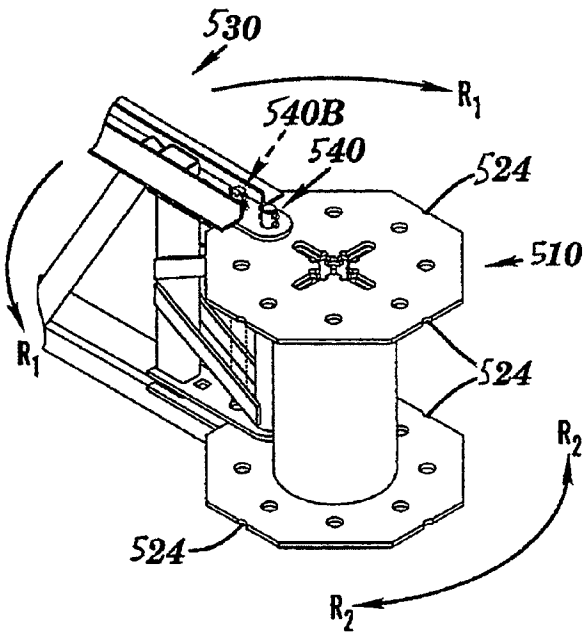
FIGS. 8A and 8B respectively show exploded top perspective view and top perspective views of an example interconnection between the hub and joist of FIGS. 7 and 8, as can be employed in forming the platform portions of FIG. 6.
Figure 8A:
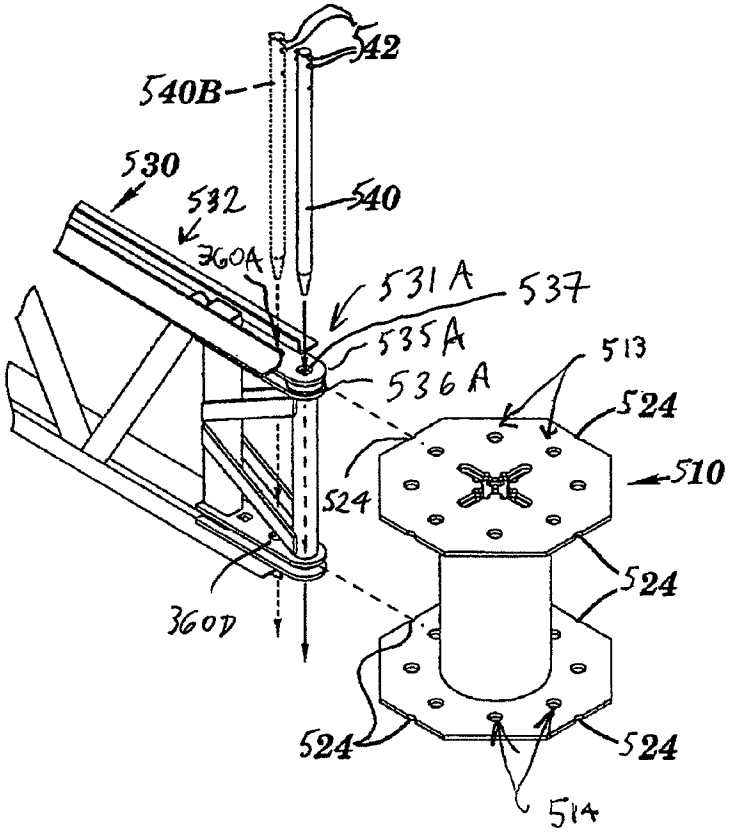

FIG. 7 depicts a top perspective view of the interconnection between a single one of the hubs 510 and a single one of the joists 530, while FIGS. 8A and 8B show an exploded close-up view, and a regular (unexploded) perspective close-up view, respectively, of a typical connection between the hub 510 and joist 530. As shown, the joist 530 includes an upper element 532 and a bottom element 533. Interspersed between the elements 532, 533 are a plurality of diagonal support members 538. Each of the elements 532; 533 is made of two L-shaped pieces of angle iron 539A, 539B. The elements 532, 533 typically can be identical in construction, with the exception being that the upper element 532 includes connector holes 554A, 554B at its midspan. The joist 530 includes a first end 531A and a second end 531B. At each of the ends 531A, 531B of both the upper element 532 and bottom elements 533, there extends an upper connecting flange 535 and a lower connecting flange 536. Additionally, through each of the upper and lower connecting flanges 535, 536, there are connecting holes 537. Thus, there are four upper connecting flanges 535A, 535B, 535C, 535D and four lower connecting flanges 536A, 536B, 536C, 536D on the joist 530.

Thus, at a first end 531A, extending from the upper element 532, is an upper connecting flange 535A and lower connecting flange 536A, with a connecting hole 537A therethrough (see also FIG. 8A). Similarly, at the second end 531B of the upper element 532, there extends an upper connecting flange 535B and lower connecting flange 536B, with a connecting hole 537B therethrough. Also, at the first end 531A of the lower element 533 there extends an upper connecting flange 535D and lower connecting flange 536D. Through these connecting flanges 535D, 536D are a connecting hole 537D. Further at the second end 531B of the joist 530 extending from the lower element 533 is an upper connecting flange 535C and lower connecting flange 536C with a connecting hole 537C therethrough. In addition to the respective connecting holes 537A, 537B, 537C, 537D, each of the connecting flanges 535A, 535B, 535C, and 535D additionally includes a respective additional locking hole 360A, 360B, 360C, 360D, respectively, all of which are located inwardly of the respective connecting holes (that is, axially toward the center of the joist 530 relative to the connecting holes).

Further as shown in FIGS. 8A and 8B, pins 540 can be placed through the connecting holes 537 of the connecting flanges 535, 536 at each of the first end 531A and second end 531B of the joist 530 and further through any two corresponding ones of the openings 513, 514 of the hub 510. FIGS. 8A and 8B particularly show one of the pins 540 employed at the first end 531A, it being understood that the same or substantially same arrangement can be present at the end 531B. In this manner, the joist 530 can be connected in a virtually limitless number of ways, and angles, to the hub 510. For example, as shown particularly in FIGS. 8A and 8B, one of the pins 540 can be placed in through the connecting flange 535A, through the opening 513A, through the connecting flange 536A (all at the first end 531A of the upper element 532), through the connecting flange 535D, through the opening 514A, and then through the connecting flange 536D. In this scenario, the pin 540 further threads through connecting holes 537A and 537D.

The pin 540 additionally includes two roll pins 542 at its upper end. The lower of the two roll pins 542 acts as a stop, thereby preventing the pin 540 from slipping all the way through the joist 530 and hub 510. The upper roll pin 542 acts as a finger hold to allow easy purchase and removal of the pin 540 from the joist 530 and hub 510. The design of these various parts are such that free rotation of both the joist 530 and hub 510 is allowed, even while the joist 530 and hub 510 are connected together. Rotational arrows $R_1$ of FIGS. 7 and 8B show the rotation of the joist 530 relative to the hub 510, while rotational arrows $R_2$ show the rotation of the hub 510 relative to the joist 530 of FIGS. 7 and 8B. These rotational capabilities of the joist 530 and hub. 510 relative to one another provide, in part, the articulating capability of the present design.

Although articulation of the joist 530 and hub 510 relative to one another can occur in some embodiments, in other embodiments including an embodiment as shown in FIGS. 8A and 8B, such articulation is precluded due to the presence of optional locking pins, one of which is shown as a locking pin 540B. As shown, the locking pin 540B can be added through the locking holes 360A and 360D proximate the end 531A of the joist 530 in order to lock the joist 530 in relation to the hub 510 to prevent relative articulation, if so desired. The locking pin 540B particularly operates to preclude such articulation (at least in part) due to contact with the hub 510 along two of several grooves (or slots/dimples) 524 formed along the perimeters of the upper element 511 and lower element 512 of the hub 510. Because the locking pin 540 extends through two of the grooves 524, the locking pin effectively is prevented from moving around the perimeters of the upper and lower elements 511, 512 and correspondingly prevents such movement of the joist 530 relative to the hub 510.

As with the pin 540, the locking pin 540B can include additional two roll pins 542 as shown, which serve the same purposes as discussed above with respect to the roll pins provided on the pin 540. Although not shown in FIGS. 8A and 8B, it should be likewise understood that another of the locking pins 540B can similarly be added through the locking holes 360B and 360C proximate the end 531B (see FIG. 7) of the joist 530 when that end is connected to another one of the hubs 510 by another of the pins 540. Indeed, notwithstanding the above description of the hubs 510, joists 530, and associated components shown in FIGS. 6, 7, 8A, and 8B, it should be appreciated that these components are only example components that can be employed among the components 500 forming the underlying/internal supporting portions (e.g., the "skeleton") of the overall platform structure 440. Further, the overall platform 440 can include a variety of other components in addition to, and/or instead of, the components 500 and panel portions already discussed above.

Further in this regard, among other things, various differently-shaped components can be utilized. For example, while joists such as the joist 530 can be bar joists, the joists can also be open-web joists and/or structural tubing. Further for example, one or more of the joists 530 can be made of multiple pieces of structural tubing shapes, or the joists 530 can be one single structural tubing shape. Similarly, the joist 530 could be made of shaped steel (e.g., wide flange elements, narrow flange members, etc.), or other suitable shapes and materials. Also, additionally other types of joists that are curved rather than linear (straight) can be employed, as can other types of panel portions and supports for such panel portions. Additionally in this regard, depending upon the embodiment, other components can be employed such as any of those described in U.S. Pat. No. 7,779,599 entitled "Articulating Work Platform Support System, Work Platform System, and Methods of Use Thereof", issued on Aug. 24, 2010, which is hereby incorporated by reference herein (said issued patent being assigned to a common assignee with the present patent application).

Figure 9:
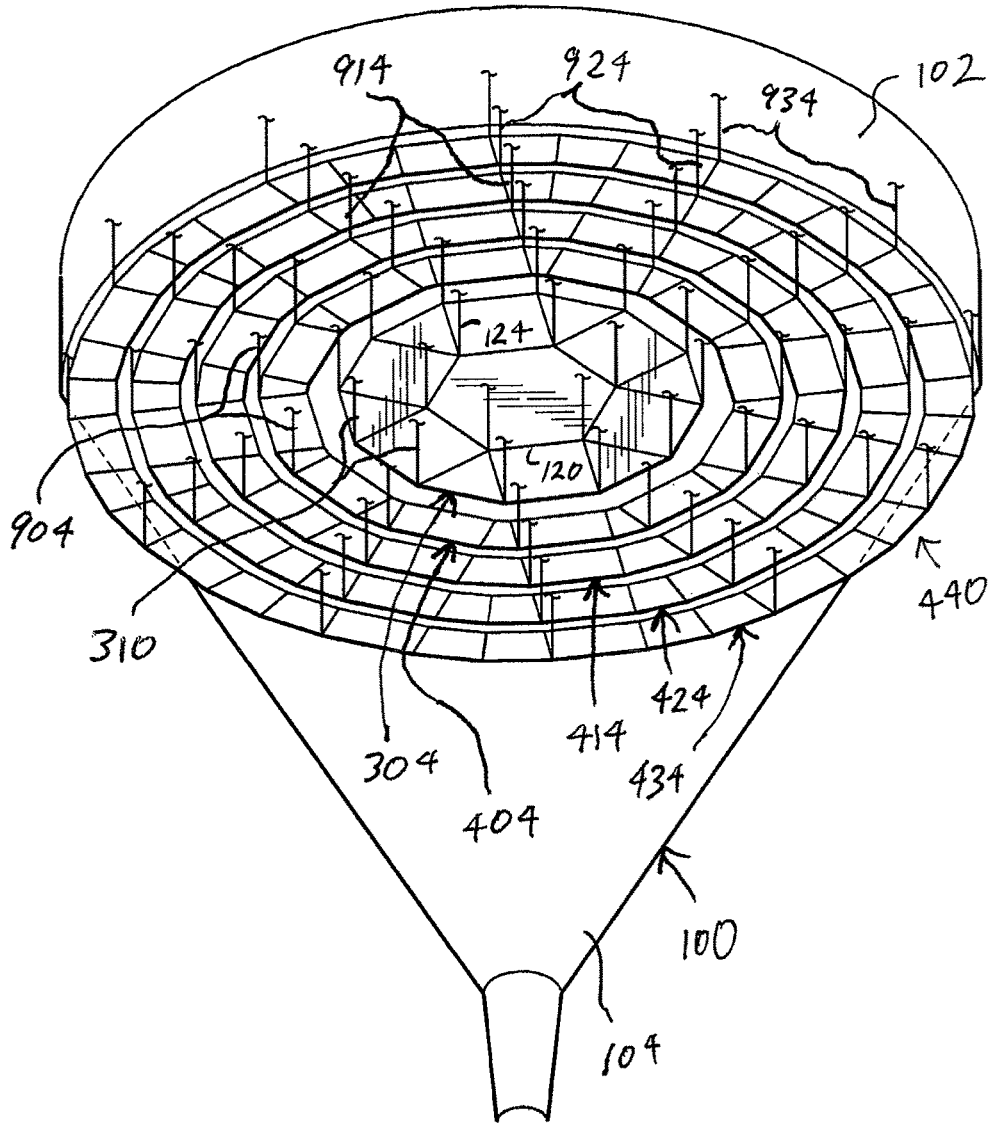
FIG. 9 is a further perspective, partially cutaway view of the vessel of FIGS. 1-4 where for convenience of illustration the upper portion (aside from the starter platform) is shown to be removed (even though the upper portion should be understood to still be present) and instead various suspension linkages are shown to be present, by which the additional extension platform portions of FIG. 4 can be understood to be connected to and supported by the rigid top beams of the cap (which, although not shown in FIG. 5, should be understood to be present in substantially the form shown in FIG. 1), and additionally where (in contrast to FIG. 4) several portions of the additional extension platform portions are shown to have been removed, in accordance with a subsequent stage of implementation of the work platform system.

Turning now to FIG. 9, a further perspective, partially cutaway view of the vessel 100 of FIGS. 1-4 is shown, where the work platform system being constructed therein is shown in yet a later stage of assembly (later than that of FIG. 4). For convenience of illustration, similar to FIG. 4, FIG. 9 only shows rear portions of the top rim 102 and the conical wall 104 of the vessel 100 (the remaining portions cutaway), and the entire cap 108 is also removed. Further, the upper portions of the starter assembly 118 (e.g., the spreader frame assembly 122) are also not shown. Nevertheless, it should be understood that, in actuality, the cap 108, the vessel 100, and the starter assembly 118, are present in their entirety (e.g., as shown in FIG. 1). At the same time, by contrast with FIG. 4, the work platform system is shown to be in a later stage of assembly insofar as now several sets of linkages 904, 914, 924, and 934 are shown to have been added, which are in addition to the linkages 124 of the starter assembly 118 itself and the additional linkages 310 already discussed with respect to FIG. 3.

More particularly, it should be appreciated that the respective sets of linkages 310, 904, 914, 924, 934 connect the additional platform portions 304, 404, 414, 424, 434, respectively, to the beams 110 of the cap 108. These connections of the additional platform portions 304, 404, 414, 424, 434 to the beams 110 by way of the linkages 310, 904, 914, 924, 934 should be understood to be present even though, for simplicity of illustration, the portions of the linkages directly linked to the beams are not shown (since the cap 108 with the beams itself is not shown). The linkages 904, 914, 924, 934 can take a variety of forms depending upon the embodiment, in the same manner as discussed above to the linkages 124 and additional linkages 310. For example, each of the linkages 904, 914, 924 934 can be flexible linkages (e.g., wire rope linkages or chain linkages) or rigid rod linkages. Relatedly, the intermediate rings 308, 408, 418, 428 previously linking those additional platform portions with one another are shown to have been removed. Thus, in this stage of construction of the work platform system, the additional platform portions 304, 404, 414, 424, 434 are all supported via the linkages 310, 904, 914, 924, 934 rather than by the starter assembly 118 as shown in FIG. 4.

Figure 10:
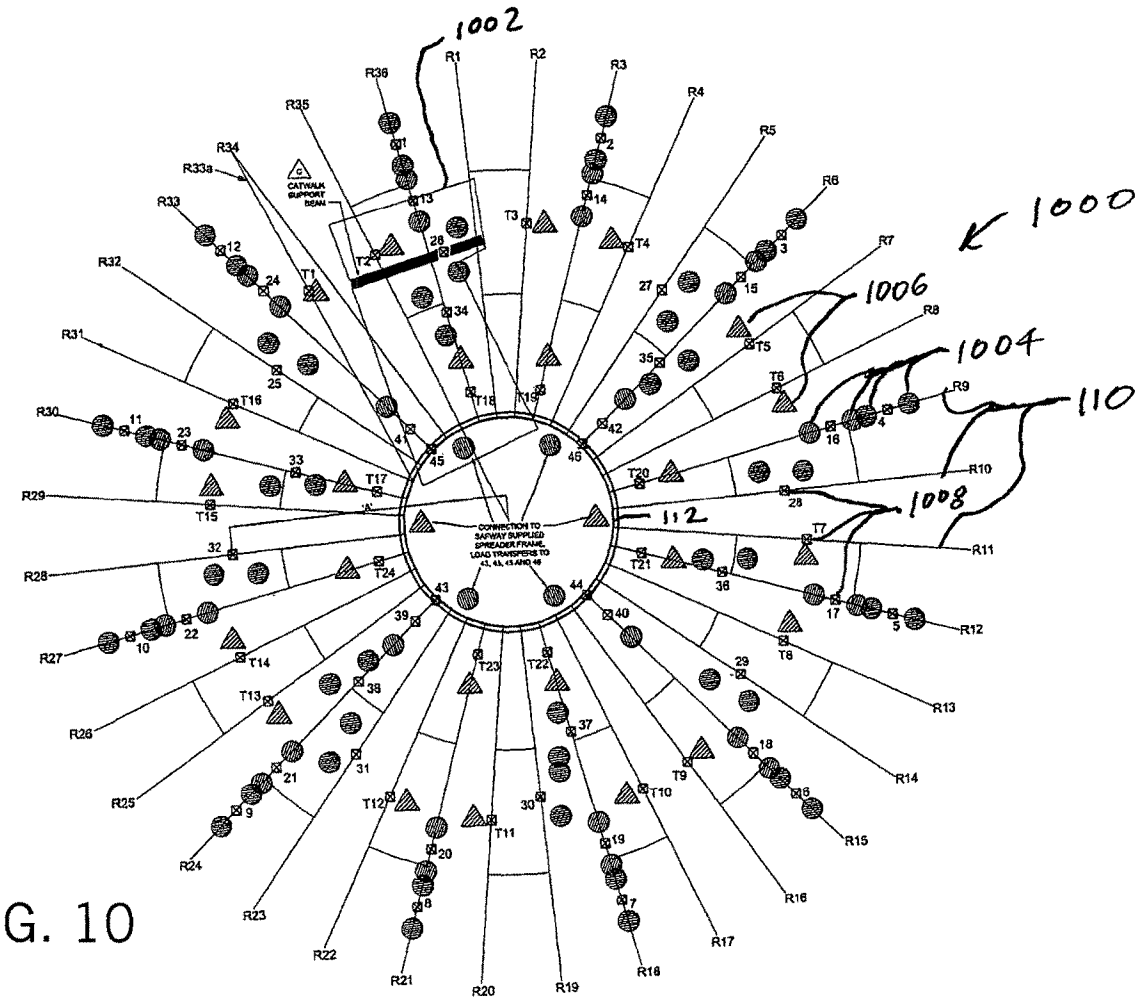
FIG. 10 is a schematic diagram corresponding to the platform portions of the work platform system shown in FIG. 5, intended to illustrate example points on the platform portions at which those portions can be suspended from the cap of FIG. 1.

Referring next to FIG. 10, a schematic diagram 1000 is provided illustrating example placement of the linkages 124, 310, 904, 914, 924, 934 in relation to the rigid beams 110 and ring 112 of the cap 108. More particularly as shown, several different types of linkages can be employed to support portions of the overall platform 440 depending upon the exact circumstance. Circular locations 1004 particularly indicate locations where hoist locations can be provided. Triangular locations 1006 indicate locations where suspension chain connections can be provided to existing rigid beams 110 (rafters), which are required for stabilizing all remaining platform rings during erection (which are to be removed after all remaining permanent suspension linkages have been installed). Finally, square locations 1008 are indicative of where beam clamp connections are located on the rigid beams 110 (rafters).

Further with respect to FIG. 10, an outline 1002 is also provided showing example positioning of a catwalk that in at least some embodiments can be present. Although the catwalk is not illustrated in FIGS. 1-9, it should be appreciated from a comparison of FIG. 10 with one or more of the FIGS. 1-9 that the catwalk as represented by the outline 1002 can extend over the platform structure 440 from a location at or proximate to the exterior of the vessel 100 such as the top rim 102 (or even from an interior surface of a portion of the cap 108) inward to the starter platform 120.

Given such an arrangement, such a catwalk can allow for personnel to cross over to the starter platform 120 when the starter platform is first in place (e.g., at the step represented by FIG. 2) so as to then attend to assembly of the various additional platform portions 300, 400, 410, 420, 430. In at least some such circumstances the catwalk leads to a location above the starter platform 120, after the starter platform has already been lowered to a level beneath the catwalk, and there is provided a ladder or similar structure allowing for personnel to then climb down to the starter platform, so as to then build out the entire remainder of the overall platform portion 440 corresponding to all of the additional platform portions 300, 400, 410, 420, 430.

Alternatively, given that the overall platform portion 440 is assembled incrementally from the numerous ones of the hubs 510 and joists 530, in other embodiments a portion or portions of the overall platform portion are built out above or at the level of the catwalk, those assembled portion(s) are then lowered to a level beneath the catwalk, and then the remaining portion(s) of the overall platform portion are added at that time to complete the overall platform portion. For example, in some embodiments, the additional platform portion 300 but not the additional platform portions 400, 410, 420, 430 are formed at a level at or above that of the catwalk but the remaining additional platform portions are formed at a level below that of the catwalk. Alternatively (and/or additionally), in some embodiments, a portion of a circular platform with sector removed (e.g., a portion of one or more of the additional platform portions 300, 400, 410, 420, 430 forming a major sector of a circular platform) is built out at or above the level of the catwalk 502, but the remaining portion (e.g., a minor sector) is left unfinished at that time so that the partially-finished portion of the circular platform can be lowered beneath the catwalk and clear the catwalk during the lowering process, after which the remaining portion of the circular platform portion is finally added so as to complete the overall platform portion 440.

Figure 11:
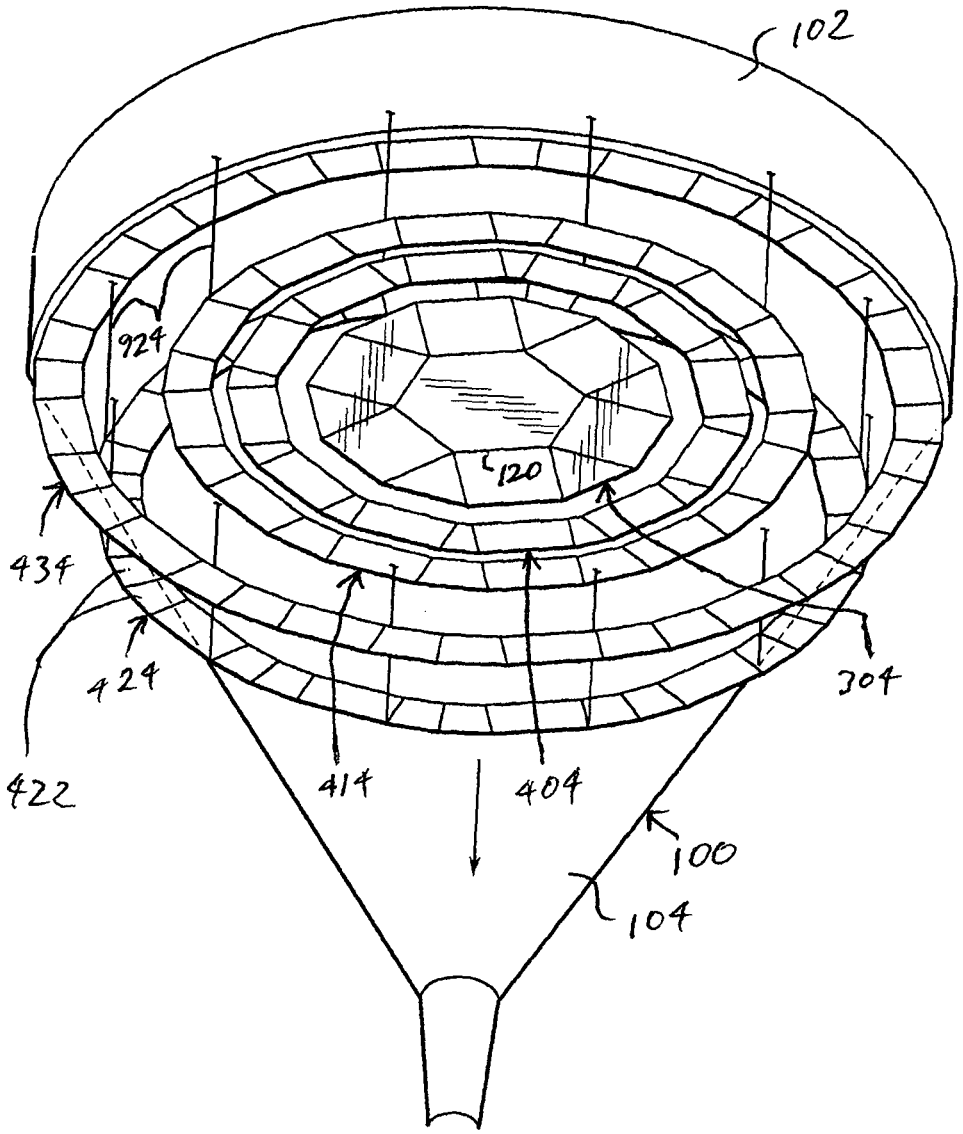
FIG. 11 is an additional perspective, partially cutaway view of the vessel of FIGS. 1-4 and 9, similar to that of FIG. 9 except insofar as now certain ones of the additional extension platform portions corresponding to a next-to-outermost one of the concentric rings has been lowered downwardly further into the vessel, in accordance with a further stage of implementation of the work platform system.

Turning to FIG. 11, an additional perspective, partially cutaway view is provided that, although similar to FIG. 9 in most respects, shows the work platform system at a further stage of construction within the vessel 100. More particularly, in this stage of construction, the platform portions 422 corresponding to the further platform ring 424 have been lowered downwardly further into the vessel, even while all the remaining platform portions remain at the level of the starter platform 120. Particularly to allow this lowering, the linkages 924 connecting the platform ring 424 with the rigid beams 110 (see FIG. 1) are lengthened (it will be noted that the other linkages for suspending the other rings have been omitted for convenience of illustration, even though such linkages actually will be present). It should be appreciated that, given the shape of the conical wall 104, the platform portions 422/fourth platform ring 424 are lowered only so far as the outer edge of those components is in contact with or in close proximity to the interior surface of the conical wall. If not in contact with the interior surface of the conical wall 104, the platform ring 424 can be the same distance from the conical wall as the outer edge of the ring 434 is from the rim 102 of the vessel 100. Thus, the platform ring 424 is able to be lowered a suitable distance below the ring 434 as determined by the shape of the conical wall 104, but not able to be lowered all of the way to the bottom of the vessel 100.

Figure 12:
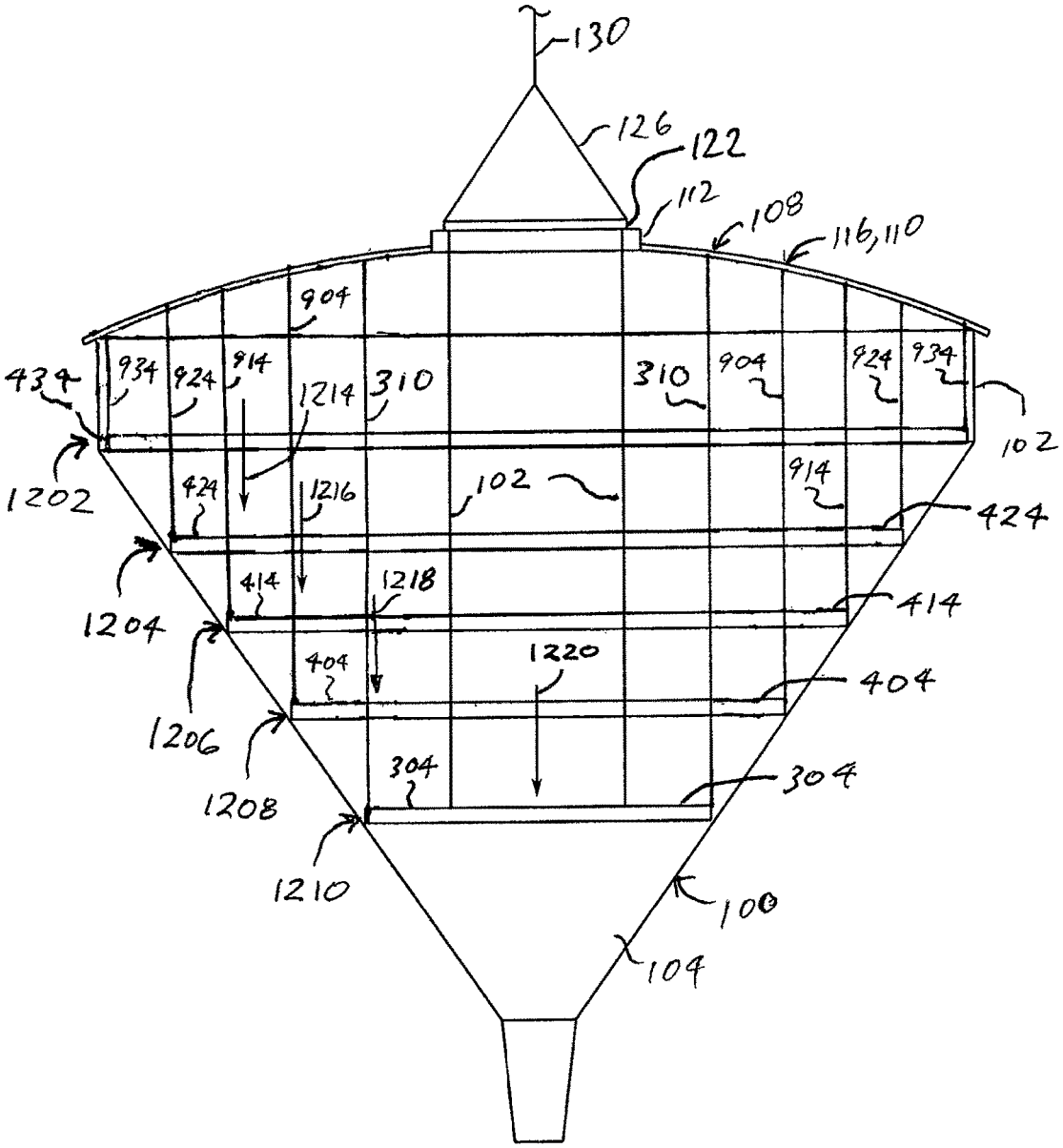
FIG. 12 is a cross-sectional schematic view of the vessel and work platform system illustrating yet later stages of implementation of the work platform system within the vessel of FIGS. 1-4, 9, and 11, where multiple successive concentric ring portions of the work platform system of successively smaller diameters have been lowered to successively lower levels within the vessel.

Although the platform ring 424 can only be lowered to a certain level as illustrated in FIG. 11, FIG. 12 shows how in additional stages (or steps) of the construction process several of the other platform portions are lowered to successively lower levels within the vessel 100. That is, FIG. 12 not only shows the platform ring 424 to have been lowered, beneath a first level 1202 at which the ring 434 remains, to a second level 1204 as represented by an arrow 1214, but also shows the platform rings 414, 404, 304 (including the starter platform 120) to have been lowered to third, fourth, and fifth levels 1206, 1208, and 1210, respectively, beneath the first level 1202. The lowering of each of the respective platform rings 414, 404, and 304 to the third, fourth, and fifth levels 1206, 1208, and 1210, respectively can be understood to occur at each of several successive stages (or steps) of the construction process, as represented by arrows 1216, 1218, and 1220, respectively. As illustrated, the lowering of each of the respective platform rings 414, 404, 304 is accomplished by adjusting or elongating the respective linkages 914, 904, and 310 by which those platform rings are connected to and supported by the rigid beams 110 of the cap 108. Insofar as the starter platform 120 remains coupled to the platform ring 304, the linkages 102 by which the starter platform is linked to the spreader frame assembly 122 also are appropriately adjusted/elongated. Notwithstanding the lowering of the various platform portions, all of the successive platform portions can be said to be positioned radially outwardly in succession relative to the starter platform 120 and vertical axis 115 (as shown in FIG. 4).

Figure 13:
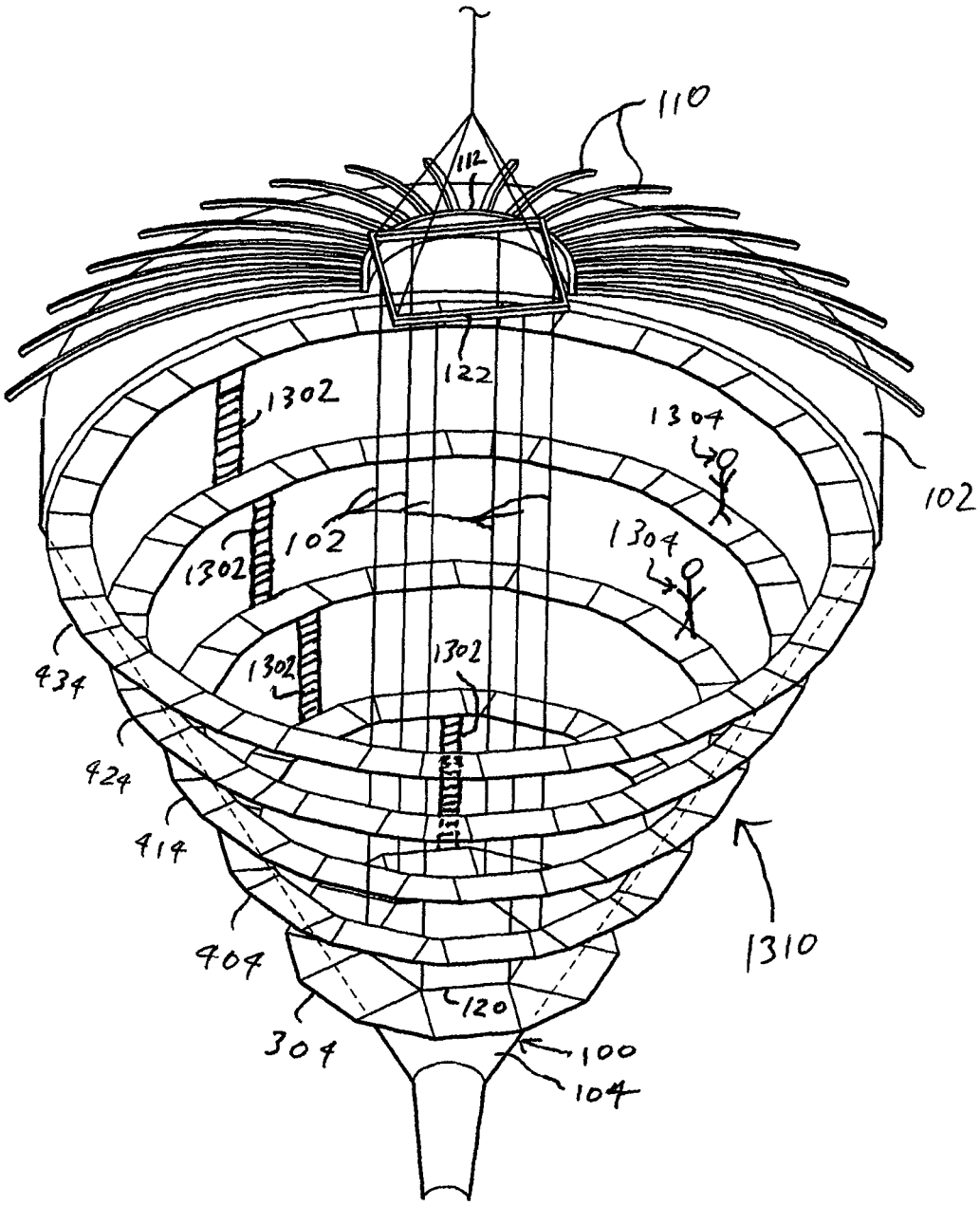
FIG. 13 is a further perspective, partially cutaway view of the vessel of FIGS. 1-4, 9, and 11-12, illustrating from another vantage point the arrangement already shown in FIG. 12, it being understood that, for clarity, many of the suspension linkages by which various different portions of the work platform system are linked to the cap are not shown.

Upon accomplishment of all of the stages of assembly described above with respect to FIG. 12, the various rings 434, 424, 414, 404, 304 (including starter platform 120) are all in final positions as shown in FIG. 12 and, in perspective view, additionally in FIG. 13. For convenience of illustration, FIG. 13 again shows a further perspective, partially cutaway view of the vessel 100 in which only rear portions of the top rim 102 and the conical wall 104 of the vessel 100 are shown (the remaining portions cutaway), and also only portions of the cap 108 are shown (particularly, several of the rigid beams 110 and a cutaway portion of the ring 112). Further, only the linkages 102 connecting the starter platform 120 to the spreader frame assembly 122 are shown. Nevertheless, it should be understood that, in actuality, the cap 108, the vessel 100, and all of the linkages discussed with respect to FIG. 12 (that is, including the linkages 310, 904, 914, 924, 934) are present in their entirety. Further as shown, FIG. 13 is representative of a final stage of assembly in which ladders 1302 have been added to connect the various rings 434, 424, 414, 404, 304 so as to allow workers 1304 to climb easily up and down between the different levels 1202, 1204, 1206, 1208, 1210 at which the various rings are located (the ladder linking the rings 404 and 304 being shown partly in phantom). Given the addition of the ladders 1302 and the finalized positioning of the various rings 434, 424, 414, 404, 304 (including the starter platform 120), the work platform assembly 1310 within the vessel 100 can be said to be in its finished form.

It should be appreciated that the work platform assembly 1310 described above is only intended as an example and that the present invention is intended to encompass numerous variations of the above-described work platform assembly, components thereof, and/or method of assembly and/or utilization. For example, while the work platform assembly 1310 includes five different work platform levels (that is different platform sections provided at the different levels 1202, 1204, 1206, 1208, 1210), in other embodiments there can be other arbitrary numbers of work platform levels. Also, the spacing of the work platform levels need not be consistent between different pairs of levels, and/or can vary depending upon the implementation or embodiment. Further although the work platform system 1310 shown in FIG. 13 is made of five different generally annular (more particularly polygonal annular) structures, namely, the rings 434, 424, 414, 404, 304 (where the lowest ring also includes the starter platform 120), in other embodiments one or more of the different structures making up the work platform system need not be a complete annulus but can be a portion of an annulus (e.g., a structure extending halfway around the interior of the conical wall 104) or be shaped in numerous other manners.

The particular shapes of the different structures of a given work platform system can vary also depending upon the size and shape of the vessel 100 or other structure within which the work platform is constructed. For example, depending upon the embodiment, the various platform portions described above can take on any of a variety of rectangular, triangular, or other polygonal shapes (further for example, the starter platform could be octagonal rather than hexagonal) or even possibly shapes other than polygonal shapes, and further the spreader frame assembly 122 need not be rectangular in all embodiments but can also take on a different polygonal or other shape. Further, as already noted, the work platform system can be configured for implementation in a conical or polygonal structure having walls that proceed inwardly toward one another as one proceeds upward rather than downward. In such implementations, the above-described process of implementing the work platform can be inverted from that discussed above. That is, in such implementations, successively inwardly-positioned portions of the work platform are raised to successively-higher positions within the conical or other structure, rather than lowered.

The materials out of which the work platform system 1310 or other work platform systems in other embodiments can be formed can vary depending upon the embodiment. For example, suitable materials for components of such work platform systems can include metal (e.g., steel, aluminum, etc.), wood, plastic, composite, or other suitable materials. Also, such components can be made of items that are solid, corrugated, grated, smooth, or of other suitable configurations. For example, panel portions of such work platform assemblies can be made of wood sheeting, plywood, roof decking material, metal on a frame, grating, steel sheeting, and the like, among other things. Also, it should be appreciated that a variety of types of linkages can be employed in supporting platform portions relative to the cap/rigid beams/rafters/spreader frame assembly, and/or other support structures. The linkages can be flexible, such as wire, wire rope, chain, or similar types of linkages, as well as in some cases rigid.

In at least some embodiments, work platform systems such as the work platform system 1310 are advantageous in that, because the work platform system is formed from multiple discrete components such as the hubs 510, joists 530, and associated panel portions, worker(s) can modify or add to existing portions of the work platform system while physically supported upon an existing, installed portion of work platform system. In at least some embodiments, worker(s) in such a circumstance can extend, relocate, or remove components of the work platform system using only hand tools, and no mechanical tools, hoists, cranes, or other equipment is required to add to, or subtract from, existing components of the work platform system. In at least some embodiments, installation of a work platform system can be done, essentially, "in the air". That is, the work platform system can be erected and connected together "in the air", in a piece-by-piece order via the use of multiple pieces of lifting, or hoisting, equipment. That said, in alternate embodiments, it is possible also that one or more of the hubs 510, joists 530, panels, and/or other components will be preassembled on the ground, or at a remote location, and then moved and hoisted as a pre-assembled module into the desired location (e.g., into a structure such as the vessel 100, where in some cases the cap 108 can also be provided as part of the pre-assembled structure).

Although not discussed above, in other embodiments other types of components can be also included in a work platform system. For example, in some embodiments, a railing system can be attached to one or more platform portions. Railings of such systems can be manufactured from a variety of materials, such as chain, cable (e.g., galvanized aircraft cable), line, and the like, among other things. For example, the railing 88 may be galvanized aircraft cable. In still additional embodiments, railing standards can also be used to erect a work enclosure system. For example, tarps, sheeting, or the like can be attached to railing standards to enclose work area(s) for various purposes.

Therefore, although certain embodiments of the present invention have been shown and described in detail above, it should be understood that numerous changes and modifications can be made without departing from the scope of the appended claims. Among other things, it should be appreciated that the scope of the present invention is not limited to the number of constituting components, the materials thereof, the shapes thereof, the relative arrangement thereof, etc., as described above, but rather the above disclosures are simply provided as example embodiments.

Thus, it is specifically intended that the present invention not be limited to the embodiments and illustrations contained herein, but include modified forms of those embodiments including portions of the embodiments and combinations of elements of different embodiments as come within the scope of the following claims.

What is claimed is:

1. A method of installing a work platform system into an internal cavity of a structure, the method comprising:

providing a plurality of platform portions including a starter platform portion and a plurality of additional platform portions;

supporting the starter platform portion at a first location in relation to the internal cavity;

adding the plurality of additional platform portions to the starter platform portion, wherein the additional platform portions are at least indirectly attached to one another, and wherein successive ones of the additional platform portions of the plurality of additional platform portions are respectively positioned at respective locations that are successively farther outward away from the starter platform portion along or proximate to a first level, such that a first of the additional platform portions is positioned in between the starter platform portion and a second of the additional platform portions, and wherein each of the additional platform portions entirely or substantially extends around the starter platform portion;

coupling at least indirectly the additional platform portions to one or more other locations on the structure so that the additional platform portions are supported in relation to the structure;

detaching the additional platform portions from one another; and lowering or raising first and second ones of the plurality of platform portions, relative to each other and each relative to a third one of the plurality of platform portions, to second and third levels below or above the first level so that the first, second, and third ones of the plurality of platform portions are respectively each positioned vertically apart from one another, wherein the first and second ones of the plurality of platform portions include at least one of the additional platform portions, and wherein the work platform system includes the starter platform portion and the additional platform portions.

2. The method of claim 1, wherein the first and second ones of the plurality of platform portions are lowered to the second and third levels, wherein the second and third levels are both below the first level, and wherein the additional platform portions are respectively positioned so that each of the successive ones of the additional platform portions extends concentrically around a respective subset of the plurality of platform portions.

3. The method of claim 2, wherein the starter platform portion is located radially inwardly of each of the additional platform portions and is lowered to a lowest of the first, second, and third levels.

4. The method of claim 3, wherein one of the additional platform portions remains at the first level and one or more others of the additional platform portions are respectively positioned at one or more additional levels above the lowest of the first, second, and third levels.

5. The method of claim 4, wherein the one of the additional platform portions that remains at the first level is a radially outermost one of the additional platform portions in relation to a vertical axis extending through the internal cavity.

6. The method of claim 2, wherein a plurality of additional structures are added to connect the platform portions with one another so as to facilitate movements of personnel or machinery among the platform portions.

7. The method of claim 1, wherein the coupling is accomplished by a plurality of linkages connecting the additional platform portions to the one or more other locations.

8. The method of claim 7, wherein the linkages include one or more of wire linkages, wire rope linkages, chain linkages, and rigid linkages.

9. The method of claim 1, wherein the detaching of the additional platform portions is accomplished by removing one or more structural components linking the additional platform portions with one another.

10. The method of claim 9, wherein the one or more structural components include one or more joists, and the detaching of the additional platform portions particularly involves removing the one or more joists from one or more hubs associated with the additional platform portions.

11. The method of claim 1, further comprising a support component in addition to the starter platform portion, the starter platform portion being coupled to the support component by way of a plurality of linkages, and wherein the supporting of the starter platform portion involves positioning the support component onto a support portion of the structure.

12. The method of claim 11, wherein the support component includes a polygonal frame, the support portion includes a ring defining an orifice, and the ring is supported by a plurality of rigid beams associated with a cap positioned above the internal cavity, wherein the supporting involves the positioning of the polygonal frame onto the ring so that corners of the polygonal frame extend outward beyond an outer circumference of the ring, and wherein the plurality of linkages extend downward from the polygonal frame through the ring and into the internal cavity to the starter platform portion.

13. The method of claim 1, wherein the lowering or raising includes the lowering, wherein the starter platform portion alone or in combination with one or more of the additional platform portions is or are positioned so as to be able to be pass by, during the lowering, a catwalk extending within the structure prior to the lowering, and wherein additional ones of the additional platform portions are added only after the passing by of the catwalk.

14. The method of claim 1, wherein each of the additional platform portions is circular or polygonal in shape.

15. A work platform system configured for implementation within a cavity defined by one or more interior walls within a structure, the work platform system comprising:

at least one component that is configured to be supported at a first location substantially above the cavity;

a plurality of platform portions including a starter platform portion and a plurality of additional platform portions, wherein the starter platform portion is coupled to the at least one component, wherein each of the additional platform portions entirely or substantially extends around the starter platform portion, and wherein the additional platform portions are configured to be positioned along or proximate to the one or more interior walls; and a plurality of suspension components by which the starter platform portion is coupled to the at least one component and the additional platform portions are linked to one or more of a plurality of additional locations substantially above the cavity, wherein first, second, and third ones of the plurality of platform portions are respectively suspended by respective ones of the suspension components so that the first and second ones of the plurality of platform portions can be independently moved relative to one another and relative to the third one of the plurality of platform portions along a vertical axis extending through the cavity and through the starter platform portion, and so that the first, second, and third ones of the plurality of platform portions are respectively positioned vertically apart from one another, wherein the first and second ones of the plurality of platform portions include at least one of the additional platform portions, and wherein the additional platform portions are respectively positioned successively outwardly relative to the vertical axis, such that a first of the additional platform portions is positioned in between the starter platform portion and a second of the additional platform portions.

16. The work platform system of claim 15, wherein each of the additional platform portions is annular or substantially annular so as to extend concentrically around a respective subset of the plurality of platform portions.

17. The work platform system of claim 16, wherein the platform portions are arranged so as to be positioned in a manner substantially conforming to the interior walls within the structure.

18. The work platform system of claim 17, wherein the platform portions are arranged so as to conform substantially to an inverted conical shape.

19. The work platform system of claim 15, wherein each of the platform portions are formed at least in part from a plurality of joist components and hub components.

20. The work platform system of claim 15, wherein the additional platform portions are configured so as to be capable of being attached to one another at least indirectly by additional detachable components, so that at a stage of assembly of the work platform system all of the additional platform portions can be supported at least indirectly upon the starter platform portion.

21. An assembly including the work platform system of claim 15, the structure including the cavity, and a plurality of support structures extending above a top of the cavity, wherein the additional platform portions are linked to one or more of the plurality of support structures via the suspension components.

22. The assembly of claim 21, wherein the structure is a conical separation vessel.

23. The work platform system of claim 15, further comprising means for connecting the starter and additional platform portions with one another so as to facilitate movement of personnel or machinery among the platform portions.

24. A method of installing a work platform system into an internal cavity of a structure, the method comprising:

providing a plurality of platform portions including a first platform portion and a plurality of additional platform portions;

supporting the first platform portion at a first location in relation to the internal cavity;

adding the plurality of additional platform portions to the first platform portion, wherein successive ones of the additional platform portions of the plurality of additional platform portions are respectively positioned at respective locations that are successively farther outward away from the first platform portion along or proximate to a first level, such that a first of the additional platform portions is positioned in between the first platform portion and a second of the additional platform portions;

coupling at least indirectly the additional platform portions to one or more other locations on the structure so that the additional platform portions are supported in relation to the structure;

detaching the additional platform portions from one another; and lowering first and second ones of the plurality of platform portions, relative to each other and each relative to a third one of the plurality of platform portions, to second and third levels below the first level so that the first, second, and third ones of the plurality of platform portions are respectively each positioned vertically apart from one another, wherein the first and second ones of the plurality of platform portions include at least one of the additional platform portions, wherein each of the additional platform portions is a respective ring-shaped platform portion that entirely or substantially extends around the first platform portion, wherein the additional platform portions are respectively positioned so that each of the successive ones of the additional platform portions extends concentrically around a respective subset of the plurality of platform portions, and wherein the coupling is accomplished by a plurality of linkages connecting the additional platform portions to the one or more other locations.

25. The method of claim 24, wherein the first platform portion is a starter platform portion that is hexagonal, and wherein at least one of the additional platform portions has twenty-four sides.

* * * * *